US005882356A

United States Patent [19]

Potter

[11] Patent Number: 5,882,356

[45] Date of Patent: Mar. 16, 1999

[54] FIBRE TREATMENT

[75] Inventor: Christopher David Potter, Derby, United Kingdom

[73] Assignee: Courtaulds Fibres (Holdings) Limited, United Kingdom

[21] Appl. No.: 888,439

[22] Filed: Jul. 7, 1997

Related U.S. Application Data

[63] Continuation of Ser. No. 416,729, filed as PCT/GB93/02155 Oct. 19, 1993, published as WO94/09191 Apr. 24, 1994, abandoned.

[30] Foreign Application Priority Data

Oct. 21, 1992 [GB] United Kingdom ..... 9222059

[51] Int. Cl.[6] ..... D01F 2/00; D01F 11/02; D06M 13/41; D06M 13/358

[52] U.S. Cl. ..... 8/116.1; 8/120; 8/190; 8/191; 8/192; 8/193; 8/194; 8/196; 8/181; 8/495; 8/542; 8/543; 8/544; 8/545; 8/546; 8/547; 8/548; 8/549; 8/930; 8/189; 8/125

[58] Field of Search ..... 8/116.1, 120, 190, 8/191, 192, 193, 194, 196, 181, 495, 542, 543, 544, 545, 546, 547, 548, 549, 930, 189, 125

[56] References Cited

U.S. PATENT DOCUMENTS

| | | |
|---|---|---|
| 2,394,306 | 2/1946 | Hentrich et al. . |
| 2,892,674 | 6/1959 | Sause et al. . |
| 2,971,815 | 2/1961 | Bullock et al. ..... 8/189 |
| 3,294,778 | 12/1966 | Randall et al. . |
| 3,383,443 | 5/1968 | Leahy et al. . |
| 3,400,127 | 9/1968 | Tesoro et al. . |
| 3,461,052 | 8/1969 | Restaino et al. . |
| 3,574,522 | 4/1971 | Rowland et al. . |
| 3,663,159 | 5/1972 | Gordon . |
| 3,839,207 | 10/1974 | Weil . |
| 3,849,169 | 11/1974 | Cicione et al. . |

(List continued on next page.)

FOREIGN PATENT DOCUMENTS

| | | |
|---|---|---|
| 40668/78 | 4/1980 | Australia . |
| 0 118 983 | 9/1984 | European Pat. Off. . |
| 0 174 794 | 3/1986 | European Pat. Off. . |
| 437 816 | 7/1991 | European Pat. Off. . |
| 466 648 | 1/1992 | European Pat. Off. . |
| 1148892 | 12/1957 | France . |
| 1158775 | 6/1958 | France . |
| 1565248 | 4/1969 | France . |
| 1576514 | 8/1969 | France . |
| 2108069 | 5/1972 | France . |
| 2273091 | 3/1974 | France . |
| 2273091 | 12/1975 | France . |
| 2407280 | 5/1979 | France . |
| 2450293 | 9/1980 | France . |
| 1444127 | 9/1969 | Germany . |
| 1928814 | 12/1970 | Germany . |
| 1930768 | 1/1971 | Germany . |
| 2111038 | 9/1972 | Germany . |
| 2118224 | 11/1972 | Germany . |
| 2242939 | 3/1973 | Germany . |
| 2209255 | 9/1973 | Germany . |
| 2249321 | 5/1974 | Germany . |
| 2554790 | 7/1976 | Germany . |
| 2558163 | 7/1976 | Germany . |
| 2551410 | 5/1977 | Germany . |
| 236581 | 6/1986 | Germany . |
| 48-015234 | 5/1973 | Japan . |
| 48-092668 | 12/1973 | Japan . |
| 49-001870 | 1/1974 | Japan . |
| 49-080392 | 8/1974 | Japan . |
| 49-80392 | 8/1974 | Japan . |
| 50-017593 | 6/1975 | Japan . |
| 50-112598 | 9/1975 | Japan . |
| 50-112599 | 9/1975 | Japan . |
| 51-035786 | 3/1976 | Japan . |
| 52-070187 | 6/1977 | Japan . |
| 52-033718 | 8/1977 | Japan . |
| 52-111922 | 9/1977 | Japan . |
| 52-039479 | 10/1977 | Japan . |
| 52-141843 | 11/1977 | Japan . |
| 53-035017 | 4/1978 | Japan . |
| 53-078377 | 7/1978 | Japan . |
| 53-122880 | 10/1978 | Japan . |
| 55-023093 | 6/1980 | Japan . |
| 62-044077 | 9/1987 | Japan . |
| 62-210054 | 9/1987 | Japan . |
| 62-057744 | 12/1987 | Japan . |
| 64-000505 | 1/1989 | Japan . |
| 1271238 | 10/1989 | Japan . |
| 1297430 | 11/1989 | Japan . |
| 3197128 | 8/1991 | Japan . |
| 42-18502 | 8/1992 | Japan . |
| 4241179 | 8/1992 | Japan . |

(List continued on next page.)

OTHER PUBLICATIONS

M. Hurwitz et al, "Dialdehydes as Cotton Cellulose Cross–Linkers", Textile Research Journal, 28(3):257–262 (Mar., 1958).

H. Nemec, "Fibrillation of Cellulosic Materials—Can Previous Literature Offer a Solution?", Lenzinger Berichte, 9:69–72 (Sep., 1994).

M. Dube et al, "Precipitation and Crystallization of Cellulose from Amine Oxide Solutions", in *Proceedings of the Technical Association of the Pulp and Paper Industry, 1983 International Dissolving and Speciality Pulps Conference,* TAPPI Press, pp. 111–119 (1983) (Month Unknown).

(List continued on next page.)

*Primary Examiner*—Alan Diamond
*Attorney, Agent, or Firm*—Howson and Howson

[57] ABSTRACT

The fibrillation tendency of solvent-spun cellulose fiber is reduced by treating the previously dried fiber with a chemical reagent containing at least two functional groups which are reactive with cellulose and which are electrophilic carbon—carbon double bonds, particularly vinyl sulfone groups, or precursors thereof or electrophilic three-membered heterocyclic rings or precursors thereof. The chemical reagent is preferably colorless and is preferably applied to the fiber from aqueous solution. The fiber may be contained in a woven or knotted fabric.

13 Claims, No Drawings

U.S. PATENT DOCUMENTS

| | | | |
|---|---|---|---|
| 3,849,409 | 11/1974 | Weil . | |
| 3,883,523 | 5/1975 | Parton . | |
| 4,090,844 | 5/1978 | Rowland . | |
| 4,246,221 | 1/1981 | McCorsley . | |
| 4,336,023 | 6/1982 | Warburton . | |
| 4,371,517 | 2/1983 | Vanlerberghe . | |
| 4,416,698 | 11/1983 | McCorsley . | |
| 4,443,355 | 4/1984 | Murata et al. . | |
| 4,483,689 | 11/1984 | Welch . | |
| 4,563,189 | 1/1986 | Lewis . | |
| 4,659,595 | 4/1987 | Walker et al. . | |
| 4,743,267 | 5/1988 | Dyer . | |
| 4,908,097 | 3/1990 | Box . | |
| 5,310,424 | 5/1994 | Taylor | 8/190 |
| 5,403,530 | 4/1995 | Taylor . | |
| 5,562,739 | 10/1996 | Urben | 8/116.4 |
| 5,580,356 | 12/1996 | Taylor | 8/116.1 |
| 5,759,210 | 6/1998 | Potter et al. | 8/181 |
| 5,779,737 | 7/1998 | Potter et al. | 8/194 |

FOREIGN PATENT DOCUMENTS

| | | |
|---|---|---|
| 42-98516 | 10/1992 | Japan . |
| 71100 | 9/1976 | Poland . |
| 543484 | 12/1973 | Switzerland . |
| 465384 | 10/1975 | U.S.S.R. . |
| 576270 | 3/1946 | United Kingdom . |
| 734 974 | 8/1955 | United Kingdom . |
| 810352 | 3/1959 | United Kingdom . |
| 878655 | 10/1961 | United Kingdom . |
| 936399 | 9/1963 | United Kingdom . |
| 950073 | 2/1964 | United Kingdom . |
| 953171 | 3/1964 | United Kingdom . |
| 1142428 | 2/1969 | United Kingdom . |
| 1271518 | 4/1972 | United Kingdom . |
| 1354406 | 5/1974 | United Kingdom . |
| 2 007 147 | 5/1979 | United Kingdom . |
| 2043525 | 10/1980 | United Kingdom . |
| 2103639 | 11/1984 | United Kingdom . |
| WO81/03274 | 11/1981 | WIPO . |
| WO92/07124 | 4/1992 | WIPO . |
| WO92/19807 | 11/1992 | WIPO . |
| WO94/20656 | 9/1994 | WIPO . |

OTHER PUBLICATIONS

"Radiopaque Polymers to Safety", Encyclopedia of Polymer Science and Engineering, vol. 14, pp. 45–46, 57–59, John Wiley & Sons, Inc. (1988) (Month Unknown).

"Styrene Polymers to Toys", Encyclopedia of Polymer Science and Engineering, vol. 16, pp. 16 and 685, John Wiley & Sons, Inc. (1989) (Month Unknown).

P. Pavlov et al, "Properties of Viscose Fibres Modified in an As–spun State by Cross–Linking", J. Textile Institute, 78(5):357–361 (Sep.–Oct., 1987).

R. Moncrieff, "Man–Made Fibres", 6th Edition, 6:882–895, 900–925 (1975) (Month Unknown).

U.S. Ser. No. 518,779, Welch, filed Feb. 17, 1984.

U.S. Ser. No. 342,133, Reine et al., filed Mar. 16, 1973.

U.S. Ser. No. 501,418, Rowland et al., Aug. 28, 1974.

U.S. Ser. No. 118,948, Rowland et al., Sep. 26, 1980.

"Textile Resins", in Encyclopedia of Polymer Science and Technology, 16:682–699 (1989) (Month Unknown).

"Dyeing" in Encyclopedia of Polymer Science and Engineering, 5:226–245 (1986) (Month Unknown).

S. Kulkami et al, "Textile Dyeing Operations", pp. 2–3, 84–105 (1986) (Month Unknown).

"Dyes, Reactive" in Kirk–Othmer, Encyclopedia of Chemical Technology, 3rd edition, 8:374–385 (1979) (Month Unknown).

R. Rosenthal, "Genesis" Fiber Developed by Courtaulds, Nonwovens Ind., 17(8):33, Paperchem No. 57–06976 (Abstract) (Aug., 1986).

"New Generation of Cellulose Fibers", Melliand Textilberichte/International Textile Reports, 72(2):94, Textile Technol. Dig. No. 03135/91 (Abstract) (Feb., 1991).

"Lenzing Opens Solvent–Spinning Line for Cellulose Fibres", Nonwovens Rep. Int., 237:6–7, Pira Abstract No. 07–91–00562 (Abstract) (Dec., 1990).

J. Marsh, "An Introduction to Textile Finishing", 2d ed., Chapman and Hall Ltd. (London, 1966) (Month Unknown.

Ullmann's Encyclopedia of Industrial Chemistry, Fifth, Completely Revised Edition, vol. A10: "Ethanolamines to Fibers, 4. Synthetic Organic", Section 4.2.2. Washing and Finishing, VCH (Weinheim, 1987) (Month Unknown).

R. Moncrieff, "Man–Made Fibres", 5th ed., p. 211 (1970) (Month Unknown).

"Man–Made Fibers Science and Technology", vol. 2, p. 33, Interscience Publishers (1968) (Month Unknown).

E. Flick, "Textile Finishing Chemicals, in Industrial Guide", p. 372 (Mar., 1990).

S. Anand et al, "The Dimensional Properties of Single–Jersey Loop–Pile Fabrics, Part II: Studies of Fabrics with Textured Continuous–filament Yarns in the Ground Structure", J. Text. Inst., 5:349 (1987) (Month Unknown).

H. Nasr et al, "Wood Blends with Improved Dyeability and Stain–release Properties Through Gamma Ray Induced Grafting", Kolor. Ert., 23(2–3):55–64 (1981) (Abstract only) (Month Unknown).

A. Hebeish et al, "Chemical Modification of Cotton Through Reaction with Alkoxy Adducts of Acrylamide and Hexahydro–1,3,5–triacryloyl–s–triazine in Nonaqueous Medium", Angew. Makromol. Chem., 91:77–97 (1980) (Abstract only) (Month Unknown).

M. El–Kashouti et al, "Utilization of Hexahydro–1,3,5–triacryloyl–s–triazine in Cotton Printing", Cellul. Chem. Technol., 12(2):223–229 (1978) (Abstract only) (Month Unknown).

S. Rowland et al, "Polymerization–crosslinking of N–methylolacrylamide in Cotton Fabric", Text. Res. J., 48(2):73–80 (1978) (Abstract only) (Month Unknown).

M. Solarz et al, "Wrinkle–resistant Finishing of Cellulose Fabrics in an Alkaline Medium with Simultaneous Dyeing with Acid Dyes", Przegl. Wlok., 31(1):28–31 (1977) (Abstract only) (Month Unknown).

M. Solarz, "Modification of Cellulose Fibers with N,N'–methylenebisacrylamide", Przegl. Wlok., 30(11–12):546–549 (1976) (Abstract only) (Month Unknown).

J. Arthur, "Photofinishing for Cotton Textiles", U.S., Agric. Res. Serv., South. Reg., ARS–S–64, 6–7 (1975) (Abstract only) (Month Unknown).

M. Kamel et al, "Creaction of Reactive Centers for Cotton, VII., Mechanism of Reaction of Cotton with Hexahydro–1, 3,5–triacryloyl–s–triazine", Text. Res. J., 45(11):800–804 (1975) (Abstract only) (Month Unknown).

M. Kamel et al, Creaction of Reaction Centers on Cotton, III., Synthesis of Some New Methylolacrylamide Derivatives, Kolor. Ert., 17(7–8):217–224 (1975) (Abstract only) (Month Unknown).

J. Bogdanski, "Binding of Cellulose Xanthation by–products with Hexahydro–1,3,5–tracryloyltriazine", Zesz. Nauk.—Akad. Ekon. Poznaniu, Ser. 1, 58:143–146 (1974) (Abstract only) (Month Unknown).

H. Nasr, "Radiation Modification of Cotton Fabrics, II., Catalytic Effect of Grafted Acids", Text. Res. J., 43(10):607–608 (1973) (Abstract only) (Month Unknown).

A. Wawrzyniak, "Dyeing Cellulose Fibers with azo Dyes Coupled to the Fiber Through a Reactive Intermediate", Przegl. Wlok., 26(6):337–347 (1972) (Abstract only) (Month Unknown).

H. Nasr, "Radiation Modification of Cotton Fabrics, I., Crosslinking Cotton Using Multifunctional Monomers", Text. Res. J., 42(8):497–499 (1972) (Abstract only) (Month Unknown).

A. Wawrzyniak et al, "Nature of the Chemical Reaction Between an Anionic Dye and Cellulose in the Presence of a Free Reactive System", Przegl. Wlok., 25(12):647–653 (1971) (Abstract only) (Month Unknown).

M. Kamel et al, "Dye Fixation Using Hexahydro–1,3,5–triacryloyl–s–triazine", Amer. Dyest. Rep., 60(3):33–34, 38, 40, 42 (1971) (Abstract only) (Month Unknown).

G. Valk et al, "Creation of Reactive Centers on Cellulose Using Hexahydro–1,3,5–triacryloyl–s–triazine", Text. Res. J., 41(4):364 (1971) (Abstract only) (Month Unknown).

F. Schlaeppi et al, "Fixation of Dyes by High Energy Irradiation", Text. Chem. Color., 2(24):414–424 (1970) (Abstract only) (Month Unknown).

G. Valk et al, "Analysis of High–Grade Finishes, 7., Chemical Detection of the Cross–linking of Cotton with N–acrylamide Derivatives", Melliand Textilber., 51(6):714–719 (1970) (Abstract only) (Month Unknown).

S. Rowland et al, "Rection of Activated Vinyl Compounds with Cotton Cellulose via Internal Catalysis", J. Appl. Polym. Sci., 14(2):441–452 (1970) (Abstract only) (Month Unknown).

M. Chekalin et al, "Fixation of Dyes Containing Labile Hydrogen on Cotton Fabrics by Means of Polyfunctional Compounds", Tekst. Prom. (Moscow), 28(9):40–43 (1968) (Abstract only) (Month Unknown).

FIBRE TREATMENT

This application is a continuation of Ser. No. 08/416,729 filed as PCT/GB93/02155 Oct. 9, 1993, published as WO94/09191 Apr. 28, 1994, now abandoned.

TECHNICAL FIELD

This invention is concerned with improvements in methods of reducing the fibrillation tendency of solvent-spun cellulose fibre.

It is known that cellulose fibre can be made by extrusion of a solution of cellulose in a suitable solvent into a coagulating bath. One example of such a process is described in U.S. Pat. No. 4,246,221, the contents of which are incorporated herein by way of reference. Cellulose is dissolved in a solvent such as a tertiary amine N-oxide, for example N-methylmorpholine N-oxide. The resulting solution is then extruded through a suitable die into an aqueous bath to produce an assembly of filaments which is washed in water to remove the solvent and is subsequently dried. This process is referred to as "solvent-spinning", and the cellulose fibre produced thereby is referred to as "solvent-spun" cellulose fibre. Solvent-spun cellulose fibre is to be distinguished from cellulose fibre made by other known processes which rely on the formation of a soluble chemical derivative of cellulose and its subsequent decomposition to regenerate the cellulose, for example the viscose process.

Fibre may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Dyed fabric containing fibrillated fibre tends to have a "frosted" appearance, which may be aesthetically undesirable. Such fibrillation is believed to be caused by mechanical abrasion of the fibres during treatment in a wet and swollen state. Wet treatment processes such as dyeing processes inevitably subject fibres to mechanical abrasion. Higher temperatures and longer times of treatment generally tend to produce greater degrees of fibrillation. Solvent-spun cellulose fibre appears to be particularly sensitive to such abrasion and is consequently often found to be more susceptible to fibrillation than other types of cellulose fibre. The present invention is concerned with the treatment of solvent-spun cellulose fibre so as to reduce or inhibit its tendency to fibrillate. It has however been found that some such treatments may have detrimental effects on the mechanical properties of the fibre such as its tenacity and extensibility, for example by embrittling the fibre, or on the processability of the fibre and fabric, in particular its dyeability. It can be difficult to identify a method of treatment which provides a satisfactory reduction in fibrillation tendency while avoiding such detrimental effects.

BACKGROUND ART

EP-A-538,977 describes a process for providing a solvent-spun cellulose fibre with a reduced fibrillation tendency, in which process the fibre is treated with a chemical reagent having two to six functional groups reactive with cellulose. It states that the untreated fibre and the treated fibre are preferably of substantially the same colour and that the functional groups reactive with cellulose are those generally used in fibre-reactive dyes for cellulose, for example as described in an article entitled "Dyes, Reactive" in Kirk-Othmer, Encyclopaedia of Chemical Technology, 3rd edition, Volume 8 (1979, Wiley-Interscience) at pages 374–392. Preferred examples of such functional groups are said to be reactive halogen atoms attached to a polyazine ring, for example fluorine, chlorine or bromine atoms attached to a pyridazine, pyrimidine or sym-triazine ring. Other examples of such functional groups are said to include vinyl sulphones and precursors thereof. The great majority of the chemical reagents utilised in the Examples in EP-A-538,977 contain halogen atoms attached to a polyazine ring as the only functional groups reactive with cellulose, but one commercial dyestuff which is used in the Examples contains as the functional groups one chlorine atom and one vinyl sulphone group attached to a triazine ring.

FR-A-2273091 describes a method of manufacturing polynosic viscose rayon fibre with reduced tendency to fibrillation. In that method the fibre is treated in the primary gel state characteristic of polynosic viscose rayon manufacture with a crosslinking agent containing at least two acrylamido groups and an alkaline catalyst. This primary polynosic gel is a highly swollen gel having a water imbibition of 190–200%, which is found only in polynosic viscose rayon that has never been dried. Water imbibition is defined as the weight of water retained per unit weight of bone-dry material. By way of comparison, never-dried conventional viscose rayon fibre is known generally to have a water imbibition in the range 120–150%. Triacryloylhexahydro-1,3,5-triazine and N,N'-methylenebisacrylamide are mentioned in FR-A-2273091 as preferred examples of crosslinking agent.

DISCLOSURE OF THE INVENTION

The present invention provides in one aspect a process for the manufacture of solvent-spun cellulose fibre with a reduced tendency to fibrillation wherein the fibre is treated with a chemical reagent containing two or more functional groups reactive with cellulose, characterised in that the fibre has previously been dried and in that the reagent contains as functional groups reactive with cellulose at least two groups selected from the class consisting of electrophilic carbon—carbon double bonds and precursors thereof and electrophilic three-membered heterocyclic rings and precursors thereof.

It has surprisingly been found that the selection in combination of the characterising features of the present invention offers advantages in reducing fibrillation tendency over any treatment previously disclosed. These features are the selection of previously-dried fibre and the selection of electrophilic carbon—carbon double bonds or electrophilic three-membered heterocyclic rings as the functional groups.

The present invention provides in another aspect a process for the manufacture of solvent-spun cellulose fibre with a reduced tendency to fibrillation wherein the fibre is treated with a chemical reagent containing two or more functional groups reactive with cellulose, characterised in that the fibre has previously been dried and in that the reagent reacts with the cellulose with the formation of at least two aliphatic ether groups. These aliphatic ether groups are derived from cellulose hydroxyl groups.

The chemical reagent preferably contains electrophilic carbon—carbon double bonds as the functional groups reactive with cellulose. The electrophilic carbon—carbon double bonds are activated towards addition of a nucleophile and are polarised by substitution with at least one electron-withdrawing group. Cellulose contains hydroxyl groups which react with the electrophilic carbon—carbon double bonds in the chemical reagent by Michael addition to form ether groups. Electrophilic carbon—carbon double bonds substituted with a single electron-withdrawing group are generally preferred. Examples of suitable electron-withdrawing groups include carbonyl groups, for example amide or ester groups, and sulphone groups. Preferred examples of such functional groups include acrylamido and acrylate ester groups. Precursors of electrophilic carbon—carbon double bonds include beta- sulphatoethyl sulphone and beta-chloroethyl sulphone groups. The carbon—carbon double bond is preferably the double bond in a vinyl group. A preferred example of such a functional group is the vinyl sulphone group. Additional substitution on the double bond generally reduces the reactivity of the bond towards addition of a nucleophile. The hydroxyl groups in cellulose react with such reagents to form —$XCH_2CH_2O$— groups, wherein X represents an electron-withdrawing group such as —CO— or —$SO_2$— and the oxygen atom is derived from a cellulose hydroxyl group.

The chemical reagent may alternatively contain electrophilic three-membered heterocyclic rings as the functional groups reactive with cellulose. Examples of such rings are aziridine rings, in which the carbon atoms are preferably unsubstituted and the nitrogen atom is a tertiary nitrogen atom. The hydroxyl groups in cellulose react with the aziridine rings in such reagents to open the ring with the formation of an —$NHCH_2CH_2O$— group, wherein the cellulose is linked to the reagent by an ether group. Examples of precursors of aziridine rings include 2-chloroethylamino, 2-sulphatoethylamino, 2-chloroethylamido and 2-chloroethyl-sulphonamido groups.

The bonds in the chemical reagent are preferably resistant to chemical hydrolysis under the conditions normally experienced in fabric processing and laundering, and chemical reagents in which the functional groups are vinyl sulphone groups or particularly acrylamido groups may therefore be preferred. The functional groups in the reagent may be the same or different. The chemical reagent may additionally contain one or more functional groups of types other than electrophilic carbon—carbon double bonds, for example reactive halogen atoms attached to a polyazine ring.

The method of treatment of the invention has the advantage that the bonds formed between the reagent and cellulose resist chemical hydrolysis under the conditions normally experienced in fabric processing and laundering, in particular chemical hydrolysis by mild alkali. These bonds are aliphatic ether groups. It has been found that when solvent-spun cellulose fibre is treated instead with a reagent of the halogenated polyazine type, as described in EP-A-538,977, the reduction in fibrillation tendency so obtained tends to be lost when fabric containing the treated fibre is scoured and laundered. Such reagents react with cellulose to form a multiplicity of aromatic/aliphatic ether groups which are believed to be prone to chemical hydrolysis during fabric processing and laundering.

It is known that fibre-reactive dyestuffs containing vinyl sulphone and in particular acryloylamino (acrylamido) groups are less reactive towards cellulose than dyestuffs which are reactive acid chlorides (imide chlorides), in particular dichlorotriazine and dichloropyrimidine reactive dyes. It was therefore surprising to find that such less reactive groups are highly effective in a treatment to reduce fibrillation tendency.

The chemical reagent generally contains as functional groups reactive with cellulose two to six, preferably three to six, often three or four, commonly three, electrophilic carbon—carbon double bonds or three-membered heterocyclic rings or precursors of either of these. The chemical reagent preferably contains at least one ring with at least three, in particular three, cellulose-reactive functional groups attached thereto. Examples of such rings are polyazine rings, for example diazine or triazine rings, which may be hydrogenated. A preferred example of the reagent is triacryloylhexahydrotriazine (1,3,5-tri-propenoylperhydro-1,3,5-triazine, abbreviated as TAHT), which has previously been suggested as a dye fixative. Other examples of the reagent include the reaction product of two molecules of TAHT with one molecule of a bifunctional reagent capable of reacting with TAHT, for example an aliphatic diol. Another example of the reagent is 2,4,6-tris(1-aziridinyl)-1,3,5-triazine. A further example of the reagent is N,N'-methylenebisacrylamide.

Solvent-spun fibre which has been treated by the process of the invention is preferably of substantially the same colour as the untreated fibre. This can be achieved by the use of a chemical reagent which is substantially colourless and so does not substantially alter the colour of the fibre by the treatment, for example TAHT. Such treated fibre is thereafter suitable for dyeing in any manner known for cellulose fibres, yarns or fabrics.

The chemical reagent is preferably applied to the fibre in the form of an aqueous solution. The chemical reagent may contain one or more solubilising groups to enhance its solubility in water. A solubilising group may be an ionic species, for example a sulphonic acid group, or a nonionic species, for example an oligomeric poly(ethylene glycol) or poly(propylene glycol) chain. Nonionic species generally have less effect on the essential dyeing characteristics of the cellulose fibre than ionic species and may be preferred for this reason. The solubilising group may be attached to the chemical reagent by a labile bond, for example a bond which is susceptible to hydrolysis after the chemical reagent has reacted with the cellulose fibre.

The known processes for the manufacture of solvent-spun cellulose fibre include the steps of:

(i) dissolving cellulose in a solvent, in particular a tertiary amine N-oxide, to form a solution, the solvent being miscible with water;

(ii) extruding the solution through a die to form a fibre precursor;

(iii) passing the fibre precursor through at least one aqueous bath to remove the solvent and form the fibre and wash the fibre; and (iv) drying the fibre.

The wet fibre at the end of step (iii) is never-dried fibre and typically has a water imbibition in the range 120–150%. The dried fibre after step (iv) typically has a water imbibition of around 60–80%. Solvent-spun cellulose fibre is treated according to the process of the invention after it has been dried, that is to say subsequent to step (iv).

The process of the invention may be carried out using conventional techniques for fibre-reactive dyeing of cellulose, in which the chemical reagent is used in the same manner as or a similar manner to a reactive dyestuff. The process may be carried out on tow or staple fibre, yarn or woven or knitted fabric. It is preferably carried out on fabric prior to any dyeing process and further preferably during a scouring treatment, although it may alternatively be carried out concurrently with or subsequently to a dyeing process or in both a scouring process and a dyeing process. Conventional dyestuffs for cellulose, for example direct or reactive dyestuffs, may be used in such dyeing processes. The process of the invention may be carried out using a dye bath which contains both a conventional reactive dyestuff and the chemical reagent. The functional groups in any such dyestuffs and reagents may be the same or different chemical species.

The fibrillation tendency of cellulose fibre can be reduced by use of the process of the invention without markedly reducing the dyeability of the fibre. It has been found possible to strip dye from dyed fibre or fabric treated according to the invention and subsequently to re-dye it without excessive fibrillation. The fibre or fabric continues to exhibit a low fibrillation tendency after the relatively severe type of chemical treatment required to strip dye from a fibre or fabric.

The electrophilic carbon—carbon double bonds in the chemical reagent used in the process of the invention may react most rapidly with cellulose under alkaline conditions. It may therefore be preferred to treat the solvent-spun fibre with a mildly alkaline aqueous solution of the chemical reagent, for example from an aqueous solution made alkaline by the addition of sodium carbonate (soda ash) or sodium hydroxide. When TAHT is used as the chemical reagent the pH of the solution is preferably in the range 10 to 13, more preferably 10.5 to 11.5. Alternatively, the fibre may be treated using a two-stage technique, in which the fibre is treated firstly with mild aqueous alkali and secondly with the solution of the chemical reagent, although this may generally be less preferred. Such initial treatment of a fibre or fabric with alkali is known in the dyeing trade as presharpening. The solution of the chemical reagent used in the second step of the two-stage technique may or may not contain added alkali.

The electrophilic groups in the chemical reagent may react with cellulose at room temperature, but it is generally preferable to apply heat to induce a substantial extent of reaction. For example, the reagent may be applied using a hot solution, or the fibre wetted with the reagent may be heated or steamed, or the wetted fibre may be heated to dry it. If the fibre or fabric is steamed, then low-pressure steam is preferably used, for example at a temperature of 100 to 110° C., and the steaming time may be for example 5 to 20 minutes.

The fibre may be rinsed with a mildly acidic aqueous solution, for example a weak solution of acetic acid, after reaction of the chemical reagent with the cellulose in order to neutralise any added alkali.

The fibre may be treated so as to react with 0.1 to 10%, preferably 0.2 to 5%, more preferably 0.5 to 3%, further preferably 1 to 2%, by weight of the chemical reagent, based on the weight of fibre. The chemical reagent may be reacted with the cellulose fibre so that less than 10% and preferably less than 5% of the dye sites on the cellulose fibre are occupied, so as to permit subsequent dyeing of the fibre with coloured dyes, which may or may not be reactive dyes.

The process of the invention is applicable to the treatment of fibre contained in a knitted or woven fabric. Knitted fabric has been generally found to be more susceptible to fibrillation than woven fabric. Fabric treated by the process of the invention may subsequently be processed, in particular dyed, in open width or by methods which tend to subject the fabric to more severe abrasion, for example in rope form, including jet treatment. Knitted fabric is only rarely processed in open width and is preferably treated in rope form. Woven fabric is commonly processed in open width rather than in rope form to avoid the generation of unsightly marks and creases.

It is an advantage of the invention that fibre or fabric can be treated during a conventional wet processing stage and that therefore no additional processing time or step is needed. The cost of machine time is a significant element of the cost of fibre or fabric processing and may outweigh the cost of the chemicals used.

Cellulose fibre, particularly in the form of fabrics made from such fibre, may be treated with a cellulase enzyme to remove surface fibrils. The cellulase enzyme may be in the form of an aqueous solution, and the concentration may be in the range 0.5% to 5%, preferably 1% to 3%, by weight. The pH of the solution may be in the range 4 to 6. There may be a nonionic detergent in the solution. The fabric may be treated at a temperature in the range 20° C. to 70° C., preferably 40° C. to 65° C., further preferably 50° C. to 60° C., for a period in the range 15 minutes to 4 hours. This cellulase treatment may be utilised to remove fibrils from solvent-spun fibres, yarns and fabrics which have been treated with a chemical reagent according to the method of the invention.

The invention is illustrated by the following Examples. Solvent-spun cellulose fibre commercially available from Courtaulds Fibres Limited under the Trade Mark 'Tencel' was used in all cases. Materials were assessed for degree of fibrillation using the method described below as Test Method 1 and assessed for fibrillation tendency using the techniques described below as Test Methods 2–4.

Test Method 1 (Assessment of Fibrillation)

There is no universally accepted standard for assessment of fibrillation, and the following method was used to assess Fibrillation Index (F.I.). A series of samples of fibre having nil and increasing amounts of fibrillation was identified. A standard length of fibre from each sample was then measured and the number of fibrils (fine hairy spurs extending from the main body of the fibre) along the standard length was counted. The length of each fibril was measured, and an arbitrary number, being the product of the number of fibrils multiplied by the average length of each fibril, was determined for each fibre. The fibre exhibiting the highest value of this product was identified as being the most fibrillated fibre and was assigned an arbitrary Fibrillation Index of 10. The wholly unfibrillated fibre was assigned a Fibrillation Index of zero, and the remaining fibres were evenly ranged from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined numbers for each fibre were then averaged to give a Fibrillation Index for the sample under test. It will be appreciated that visual determination and averaging is many times quicker than measurement, and it has been found that skilled fibre technologists are consistent in their rating of fibres.

Fibrillation Index of fabrics was assessed on fibres drawn from the surface of the fabric. Woven fabrics having an F.I. of more than about 2.0 to 2.5 exhibited an unsightly appearance.

Test Method 2 (Scour, Bleach, Dye)

(i) Scour 1 g fibre was placed in a stainless steel cylinder approximately 25 cm long by 4 cm diameter and having a capacity of approximately 250 ml. 50 ml conventional scouring solution containing 2 g/l Detergyl FS955 (an anionic detergent available from ICI plc) (Detergyl is a Trade Mark) and 2 g/l sodium carbonate was added, a screw cap fitted and the capped cylinder tumbled end-over-end at 60 tumbles per minute for 60 minutes at 95° C. The scoured fibre was then rinsed with hot and cold water.

(ii) Bleach 50 ml bleaching solution containing 15 ml/l 35% hydrogen peroxide, 1 g/l sodium hydroxide, 2 g/l Prestogen PC (a bleach stabiliser available from BASF AG) (Prestogen is a Trade Mark) and 0.5 ml/l Irgalon PA (a sequestrant available from Ciba-Geigy AG) (Irgalon is a Trade Mark) was added to the fibre and a screw cap fitted to the cylinder. The cylinder was then tumbled as before for 90 minutes at 95° C. The bleached fibre was then rinsed with hot and cold water.

(iii) Dye 50 ml dyeing solution containing 8% on weight of fibre Procion Navy HER 150 (a reactive dye) (Procion is a Trade Mark of ICI plc) and 55 g/l Glauber's salt was added, and the cylinder was capped and tumbled as before for 10 minutes at 40° C. The temperature was raised to 80° C. and sufficient sodium carbonate added to give a concentration of 20 g/l. The cylinder was then capped once more and tumbled for 60 minutes. The fibre was rinsed with water. 50 ml solution containing 2 ml/l Sandopur SR (a detergent available from Sandoz AG) (Sandopur is a Trade Mark) was then added and the cylinder capped. The cylinder was then tumbled as before for 20 minutes at 100° C. The dyed fibre was then rinsed and dried. It was then assessed for fibrillation using Test Method 1.

Test Method 3 (Wash and Tumble-dry)

Fabrics were subjected to wet abrasive conditions utilising a typical domestic wash and tumble-dry cycle (W/T cycle). The fabric was washed in a solution of Daz (a domestic detergent available from Procter & Gamble Limited) (Daz is a Trade Mark) for 45 minutes at 60° C.

Test Method 4 (Blender)

If the sample of fibre to be tested had not previously been scoured, it was scoured using Test Method 2(i).

0.5 g fibre cut into 5–6 mm lengths and dispersed in 500 ml water at ambient temperature was placed in a household blender (liquidiser) and the blender run for 2 minutes at about 12000 rpm. The fibre was then collected and dried and assessed for degree of fibrillation using Test Method 1. Test Method 4 provides more severe fibrillating conditions than Test Method 2.

Comparative Example 1

Never-dried solvent-spun cellulose fibre (1.7 dtex tow, 30 cm length) was padded with an aqueous alkaline solution (100 ml) containing N,N'-methylenebisacrylamide (10 g/l) and sodium sulphate (100 g/l) under various conditions, rinsed with 0.1% by volume acetic acid, and dried. F.I. was assessed by Test Method 4. Details of each treatment and of the F.I. results are set out below:

| Alkali | Treatment | F.I. |
|---|---|---|
| — | None | 5.6 (average of 4) |
| $Na_2CO_3$ (20 g/l) | Pad 3 × 5 min | 3.4 |
| $Na_2CO_3$ (20 g/l) | Steam for 10 min | 4.8 |
| $Na_2CO_3$ (20 g/l) | Steam for 20 min | 2.9 |
| NaOH (20 g/l) | Steam for 20 min | 4.4 |
| $Na_2CO_3$ (20 g/l) | 70° C. for 8 min | 3.5 |

Steaming was carried out at 100° C. and 98% R.H. The fibre was discoloured when NaOH was used as the alkali. A moderate improvement in F.I. was observed in all cases.

Comparative Example 2

Never-dried solvent-spun cellulose fibre (1.7 dtex, 30 cm length) was padded with an aqueous alkaline solution (100 ml) containing TAHT (20 g/l) under various conditions, rinsed with 0.1% by volume acetic acid, and dried. F.I. was assessed by Test Method 4. Details of each treatment and of the F.I. results are set out below:

| Alkali | $Na_2SO_4$ | Treatment | F.I. |
|---|---|---|---|
| — | — | None | 5.0 |
| $Na_2CO_3$ (20 g/l) | — | Steam for 20 min | 0.3 |
| $Na_2CO_3$ (20 g/l) | — | Dry 2 min at 120° C., steam 1 min | 0.3 |
| NaOH (20 g/l) | — | Pad at 40° C. | 0.7 |
| $Na_2CO_3$ (10 g/l) | 75 g/l | Steam for 20 min | 0.2 |
| $Na_2CO_3$ (10 g/l) | 75 g/l | Dry 2 min at 120° C., steam 1 min | 0.6 |
| $Na_2CO_3$ (10 g/l) | 50 g/l | Steam for 20 min | 0.2 |
| $Na_2CO_3$ (10 g/l) | 50 g/l | Dry 2 min at 120° C., steam 1 min | 1.2 |
| $Na_2CO_3$ (10 g/l) | — | Not heated | 3.2 |
| $Na_2CO_3$ (10 g/l) | — | Steam for 20 min | 0.1 |
| $Na_2CO_3$ (10 g/l) | — | Dry 2 min at 120° C., steam 1 min | 0.3 |

A marked improvement in F.I. was observed in almost all cases. However, the heating times required in these treatments would be unacceptable on a continuous production line for the manufacture of solvent-spun fibre.

Comparative Example 3

Three samples of never-dried solvent-spun cellulose fibre were treated with solutions of TAHT in various ways as described below. They were then scoured, bleached and dyed according to Test Method 2, with F.I. being measured after each step by Test Method 4.

Sample 1 was padded with a solution containing TAHT (20 g/l), Na3PO$_4$ (10 g/l) and $Na_2SO_4$ (25 g/l) and then heated at 70° C. for 6 minutes.

Sample 2 was padded with a solution containing TAHT (30 g/l), urea (100 g/l) and $Na_2CO_3$ (10 g/l) and then steamed at 100° C. for 20 minutes.

Sample 3 was first padded with a solution containing $Na_2CO_3$ (2 g/l) at 70° C. and then padded with a solution containing TAHT (20 g/l), $Na_2CO_3$ (8 g/l) and $Na_2SO_4$ (25 g/l) at 70° C.

The following average results for F.I. were obtained, the number of replicate experiments in each case being shown in parentheses:

| | After scour | After bleach | After dyeing |
|---|---|---|---|
| Sample 1 | 0.1 (2) | 0.5 (3) | 0.2 (3) |
| Sample 2 | 0.5 (3) | 1.7 (3) | 2.2 (3) |
| Sample 3 | 2.4 (3) | 2.4 (3) | 2.6 (3) |

Although good results were obtained on Sample 1, the heating time required would be unacceptable on a continuous production line for the manufacture of solvent-spun fibre.

EXAMPLE 1

Woven fabric of solvent-spun cellulose fibre (123 gm-2 standard weave of 20 tex ring-spun yarn of 1.7 dtex fibre) was padded with an aqueous solution of TAHT (20 g/l), $Na_2CO_3$ (10 g/l) and $Na_2SO_4$ (25 g/l) and heated for 15 minutes at 70° C. (Sample 1). A control sample was treated in the same way except that the TAHT was omitted. Another sample of fabric was padded with an aqueous solution of TAHT (20 g/l) and NaOH (20 g/l) and heated for 30 minutes at 40° C. (Sample 2). The samples of fabric were then dyed under the following conditions. The sample was immersed in a bath containing Procion Navy H4R (4% by weight on fabric) (a monochloro-triazine reactive dye available from ICI plc) (Procion is a Trade Mark), Matexil PAL (3 g/l) (a mild oxidising agent-nitrobenzenesulphonic acid-available from ICI plc) (Matexil is a Trade Mark) and Depsolube ACA (1 g/l) (an alkali-stable lubricant supplied for use in jet dyeing by ICI plc) (Depsolube is a Trade Mark) at 25° C. The temperature was raised to 80° C. while sufficient NaCl was added in three portions to give 70 g/l. The temperature was maintained for 20 minutes, sufficient $Na_2CO_3$ was added over 10 minutes to give 20 g/l and the temperature maintained for a further 60 minutes. The fabric was then rinsed and soaped off in a solution of soap flakes (2 g/l) for 20 minutes at the boil. The dyed and dried fabrics were washed and tumble-dried five times and assessed for F.I., with the following results (averages of two experiments):

| | |
|---|---|
| Control | 3.7 |
| Sample 1 | 0.8 |
| Sample 2 | 1.8 |

A knitted fabric of solvent-spun cellulose fibre (193 gm-2 tubular knit of 20 tex rotor-spun yarn of 1.7 dtex fibre) was treated and dyed in the same manner and F.I. assessed after two and four wash and tumble-dry cycles with the following results:

| | 2 cycles | 4 cycles |
|---|---|---|
| Control | 3.6 | 4.8 |
| Sample 1 | 0.0 | 0.1 |
| Sample 2 | 1.3 | 2.6 |

EXAMPLE 2

A woven fabric of solvent-spun cellulose as used in Example 1 was scoured in open width with a solution containing Detergyl (2 g/l), alkali (2 g/l), TAHT (20 g/l) and $Na_2SO_4$ (25 g/l) and heated at 95° C. for 1 hour. The nitrogen content of the scoured and dried fibre was measured by the Kjeldahl technique, and the results were expressed in terms of TAHT content by weight of the fabric. A sample of fabric treated in the same way but with the omission of TAHT was used as control. The samples of fabric were then dyed with the direct dye Solophenyl Red 3BL (available from Ciba-Geigy AG) (Solophenyl is a Trade Mark) in rope form on a winch, as follows. The fibre was immersed in a bath containing the dye (4% by weight of fabric) at 50° C., the temperature was raised to 100° C. over 30 minutes and held there for 15 minutes, sufficient $Na_2SO_4$ was added to give 20 g/l, and the temperature was maintained for a further 45 minutes, after which the fabric was washed and dried. The samples of fabric were then repeatedly washed and tumble-dried, with F.I. being assessed after each cycle, and the following results were obtained:

| | | | Wash and tumble-dry cycles | | | | | |
|---|---|---|---|---|---|---|---|---|
| | Alkali | TAHT % | 0 | 1 | 2 | 3 | 4 | 5 |
| Control | — | — | 3.3 | 3.9 | 5.4 | 4.9 | 5.6 | 6.5 |
| Sample 1 | $Na_2CO_3$ | 2.88 | 0.0 | 0.2 | 0.1 | 0.0 | 0.0 | 0.0 |
| Sample 2 | $Na_2CO_3$ | 2.40 | 0.2 | 0.0 | 0.0 | 0.0 | 0.0 | 0.2 |
| Sample 3 | NaOH | 5.28 | 0.1 | 0.0 | 0.0 | 0.0 | 0.0 | 0.0 |

Sample 3 dyed to a paler shade than the other samples, and it is thought that this sample may have been overloaded with TAHT.

EXAMPLE 3

A woven fabric of solvent-spun cellulose staple fibre as used in Example 1 was scoured in open width using a solution of Detergyl (2 g/l) and $Na_2CO_3$ (2 g/l) for 1 hour at 95° C. The fabric was then subjected to a series of treatments on a winch dyeing machine in rope form. The first treatment was with a solution containing TAHT (20 g/l), $Na_2CO_3$ (2 g/l) and $Na_2SO_4$ (30 g/l) at 20° C. for 10 minutes. Sufficient Drimarene Orange K3R (a dichloro-fluoropyrimidine reactive dye available from Sandoz AG) (Drimarene is a Trade Mark) was then added to give 4% by weight on fibre. After 10 minutes, the temperature of the bath was raised to 50° C. over 30 minutes and maintained at 50° C. for a further 20 minutes. $Na_2CO_3$ (18 g/l) was then added and treatment continued for a further 60 minutes at 50° C. The fabric was then soaped off and dried. A control sample was treated in the same way except that the TAHT was omitted. The samples of fabric were then subjected to repeated wash and tumble-dry cycles, and the following results for F.I. were obtained:

| | Wash and tumble-dry cycles | | | | | |
|---|---|---|---|---|---|---|
| | 0 | 1 | 2 | 3 | 4 | 5 |
| Control | 1.5 | 3.7 | 3.5 | 3.7 | 4.8 | 5.0 |
| Sample | 3.1 | 1.2 | 0.5 | 0.4 | 0.6 | 0.4 |

EXAMPLE 4

Fabric samples of solvent-spun cellulose fibre as used in Example 1 were scoured using a solution of TAHT (20 g/l), Detergyl (2 g/l), $Na_2CO_3$ (2 g/l) and $Na_2SO_4$ (20 g/l) at 95° C. for 1 hour. Control samples were scoured in the same way except that the TAHT was omitted. Scouring was performed either in open form on a jig or in rope form on a winch. The samples were then dyed in rope form on a winch in the following manner. The fabric was treated with a bath containing Procicn Green H4G (a monofunctional reactive dye available from ICI plc) (4% by weight on fabric), Depsolube ACA (1 g/l) (an alkali-stable lubricant supplied for use in jet dyeing by ICI plc) (Depsolube is a Trade Mark) and Matexil PAL (a mild oxidising agent—nitrobenzenesulphonic acid—used as a textile auxiliary to prevent dye reduction) (Matexil is a Trade Mark of ICI plc) (3 g/l). The fabric was run through the bath for 10 minutes at 20° C.; the temperature was then raised to 80° C. while NaCl (70 g/l) was added in portions; the temperature was maintained at 80° C. for 20 minutes; $Na_2CO_3$ (20 g/l) was added over 10 minutes; and the temperature was maintained at 80° C. for 60 minutes. The fabric was then rinsed and soaped off in a bath containing Sandopur SR (2 g/l) (a detergent available from Sandoz AG) (Sandopur is a Trade Mark) for 20 minutes at 95° C. The fabrics were then subjected to repeated wash and tumble-dry cycles and the following results for F.I. were obtained:

| | | | Wash and tumble-dry cycles | | | | | |
|---|---|---|---|---|---|---|---|---|
| Fabric | Scour | TAHT | 0 | 1 | 2 | 3 | 4 | 5 |
| Woven | Jig | No | 2.7 | 2.1 | 3.6 | 4.3 | 5.3 | 4.8 |
| Woven | Jig | Yes | 0.0 | 0.0 | 0.0 | 0.0 | 0.0 | 0.0 |
| Woven | Winch | No | 1.5 | 3.0 | 3.1 | 3.8 | 4.6 | 5.3 |
| Woven | Winch | Yes | 0.4 | 0.0 | 0.0 | 0.0 | 0.0 | 2.5 |
| Knitted | Winch | No | 1.4 | 3.9 | 4.2 | 4.9 | 4.2 | 5.1 |
| Knitted | Winch | Yes | 0.0 | 0.0 | 0.0 | 0.0 | 0.0 | 0.0 |

(It is thought that the result obtained with woven fabric, winch scouring using TAHT after 5 wash and tumble-dry cycles was anomalous.)

EXAMPLE 5

A single-jersey knitted fabric of solvent-spun cellulose fibre was fully processed on a jet-dyeing machine. This type of machine provides the harshest of all common processing conditions and is therefore the most likely to cause severe abrasion. The fabric was first scoured with a bath containing TAHT (20 g/l), $Na_2SO_4$ (25 g/l), Depsolube ACA (1 g/l), $Na_2CO_3$ (2 g/l) and Sandopur SR (2 g/l) at 50° C. for 10 minutes. The temperature was raised to 95° C. and maintained at that value for 60 minutes. The fabric was then rinsed with hot water. It was then treated with a bath containing $Na_2SO_4$ (70 g/l) and Tebolan UF (3 g/l) (a nonionic lubricant available from Dr. Th Böhme KG, Germany) (Tebolan is a Trade Mark) at 25° C. for 15 minutes, after which Procion Red HE-7B (4% on weight of fabric) (a bismonochlorotriazine reactive dye available from ICI plc) was added over 10 minutes. The temperature was raised to 80° C. and maintained at that value for 20 minutes. $Na_2CO_3$ (2 g/l) was added over 10 minutes and the fabric run through the machine for 1 hour, after which it was rinsed and soaped off. The fabric contained 5.16% by weight TAHT calculated from its nitrogen content (assessed by the Kjeldahl method). The side of the fabric exposed to the jet had F.I. 0.2, and this value remained unchanged through 35 wash and tumble-dry cycles. The side of the fabric exposed to the jet undergoes the most severe treatment and garments are normally made up with this side facing inwards.

EXAMPLE 6

A woven fabric of solvent-spun cellulose fibre (115 gm-2 standard weave of 20 tex ring-spun yarn of 1.7 dtex fibre) was scoured with a solution containing TAHT (20 g/l), Detergyl (2 g/l), $Na_2CO_3$ (2 g/l) and $Na_2SO_4$ (25 g/l) for 1 hour at 95° C. A control sample was scoured in the same way but with the omission of TAHT. The samples of fabric were then dyed with Procion Brown H3R (4% by weight on fabric) (a monochlorotriazine reactive dye available from ICI plc) (Procion is a Trade Mark) in the following manner. The fabric was treated with a solution containing the dye, Matexil PAL (3 g/l) and Depsolube ACA (1 g/l) at 25° C. The temperature was then raised to 80° C. while NaCl was added in three portions to give a concentration of 70 g/l. The temperature was maintained at 80° C. for 20 minutes, after which $Na_2CO_3$ was added over 10 minutes to give a total concentration of 22 g/l. Dyeing was continued for a further 60 minutes, during which time samples of dyebath and fabric were taken for analysis. The total amount of dye on each of the two fabrics was assessed by Q-value. Comparison of the treated fabric against the control gave Q=100.2% (standard =100%).

| | Standard | | Treated | |
|---|---|---|---|---|
| Time (minutes) | Dye in Bath | Dye on Fibre | Dye in Bath | Dye on Fibre |
| 0 | 100 | — | 100 | — |
| 15 | 15.4 | 87.3 | 22.7 | 84.8 |
| 30 | 12.6 | 92.7 | 16.8 | 95.7 |
| 45 | 11.1 | 95.8 | 13.9 | 95.3 |
| 60 | 13.0 | 100 | 10.1 | 100 |

The figures in the columns headed "dye in bath" are expressed as a percentage of the amount present in the bath initially. The figures in the columns headed "dye on fibre" are the percentage of the Q value developed after the arbitrary time of 60 minues.

It can be seen that the treated fabric dyed at a satisfactory rate.

EXAMPLE 7

A woven fabric of solvent-spun cellulose fibre was scoured with a solution of TAHT (20 g/l), Detergyl (2 g/l), $Na_2CO_3$ (2 g/l) $Na_2SO_4$ (25 g/l) for 1 hour at 95° C. A control sample was scoured in the same way, except that the TAHT was omitted. The treated and control samples were then dyed with either a direct or a reactive dye; treated to strip the dye from the fabric; redyed with the same dye as before; and subjected to a number of wash and tumble-dry (W/T) cycles. Fibrillation Index was assessed at each stage.

The following two methods were used to dye the fabric:

Direct dye, neutral bath method: Immerse the fabric in a solution of Sirius Super Violet F2BLL (4% by weight on fabric) (available from Bayer AG) (Sirius is a Trade Mark) and $Na_2SO_4$ (18 g/l) at room temperature; raise the temperature to 97° C. over 45 minutes; maintain temperature for 1 hour; rinse and dry.

Reactive dye, standard method: Immerse the fabric in a solution of Procion Red MX-8B (4% by weight on fabric) (available from ICI plc) (Procion is a Trade Mark) at 40° C.; maintain temperature for 10 minutes; add sufficient NaCl to give 60 g/l; maintain temperature for 30 minutes; add sufficient $Na_2CO_3$ to give 5 g/l; maintain temperature for 30 minutes; rinse; soap off using a solution of soap flakes (2 g/l) for 15 minutes at 100° C.; dry.

The following three methods were used to strip the dye from the fabric; in each case, the fabric was rinsed and dried on conclusion of the stripping treatment:

Method A: Treat fabric with a solution of $Na_2CO_3$ (6 g/l) and sodium hydrosulphite (6 g/l) for 1 hour at 100° C.

Method B: Treat fabric with a solution of sodium hypochlorite (10 g/l) for 20 minutes in the cold followed by addition of a sufficient amount of a solution of sodium bisulphite or thiosulphate (2.5 g/l) to destroy the residual hypochlorite.

Method C: Method A followed by Method B.

The results obtained for F.I. are shown in the following Tables:

| | Scoured | Dyed | Method | Stripped | Re-dyed | 1 W/T | 5 W/T |
|---|---|---|---|---|---|---|---|
| | | | Direct Dye: | | | | |
| Control | 2.2 | 1.8 | A | 1.0 | 2.4 | 7.2 | 9.2 |
| | | | B | 2.8 | 3.8 | 6.0 | 8.8 |
| | | | C | 1.6 | 3.2 | 6.2 | 8.8 |
| Treated | 1.2 | 0.6 | A | 2.2 | 0.4 | 0.4 | 0.6 |
| | | | B | 2.2 | 1.8 | 0.2 | 0.4 |
| | | | C | 2.4 | 0.4 | 0.4 | 0.4 |
| | | | Reactive Dye: | | | | |
| Control | 2.2 | 2.0 | A | 2.0 | 1.6 | 2.8 | 7.6 |
| | | | B | 1.0 | 2.6 | 3.0 | 7.0 |
| | | | C | 0.4 | 0.8 | 2.8 | 8.2 |
| Treated | 1.2 | 0.4 | A | 0.4 | 0.8 | 0.4 | 0.2 |
| | | | B | 0.2 | 1.6 | 0.6 | 0.2 |
| | | | C | 0.8 | 0.4 | 0.2 | 0.2 |

It can be seen that the redyed fabric exhibited a considerably reduced tendency to fibrillation compared with the control in each case.

EXAMPLE 8

Woven solvent-spun cellulose fabric as used in Example 1 was scoured at different values of pH using a solution of TAHT (10 g/l), Detergyl FS955 (2 g/l), $Na_2SO_4$ (5 g/l) and alkali at 95° C. for 1 hour. A control sample was scoured using a solution of Detergyl (2 g/l) and $Na_2CO_3$ (2 g/l) at 95° C. for 1 hour. The liquor to fabric ratio was 10:1. The samples were then treated with a solution of Procion Red HE-7B (4% by weight on fibre) (available from ICI plc), Matexil PAL (3 g/l) and Depsolube ACA (1 g/l) at 25° C.; the temperature was raised to 80° C. over 30 minutes while sufficient NaCl was added to give 70 g/l; the temperature was maintained for 20 minutes; sufficient $Na_2CO_3$ was added to give 20 g/l; the temperature was maintained for 60 minutes; then the fabric was rinsed and soaped off using a solution of Sandopur SR (2 g/l) for 20 minutes at 95° C. The liquor to fabric ratio was 70:1. The dried fabric was subjected to five wash and tumble-dry cycles. The Fibrillation Index of the samples was assessed, and the TAHT content of the samples estimated from their nitrogen content determined by Kjeldahl analysis. The following results were obtained:

| Alkali | pH | TAHT % | F.I. |
|---|---|---|---|
| — | — | — | 7.2 |
| $NaHCO_3$ (3 g/l) | 8.3 | 0.14 | 6.2 |
| $NaHCO_3$ (10 g/l) | 8.45 | 0.17 | 6.3 |
| $NaHCO_3$ (10 g/l) + $Na_2CO_3$ (1.02 g/l) | 9.0 | 0.39 | 5.5 |
| $Na_2CO_3$ (0.5 g/l) | 10.25 | 0.92 | 1.2 |
| $Na_2CO_3$ (2 g/l) | 10.77 | 2.23 | 0.1 |
| $Na_2CO_3$ (10 g/l) | 11.19 | 2.87 | 0.1 |
| $Na3PO_4$ (1 g/l) | 11.53 | 1.85 | 0.3 |
| $Na3PO_4$ (10 g/l) | 12.03 | 2.74 | 1.9 |
| NaOH (3 g/l) | 12.53 | 1.70 | 0.8 |

It can be seen that the level of fixation of TAHT was greater and the tendency to fibrillation was less when the pH of the scour bath was greater than 10, and that the best F.I. results were obtained at a pH in the range 10.5 to 11.5.

EXAMPLE 9

Woven or knitted solvent-spun cellulose fabric as used in Example 1 was treated on a winch with a solution containing TAHT (various amounts), Detergyl (2 g/l), $Na_2CO_3$ (10 g/l) and $Na_2SO_4$ (5 g/l) for 1 hour at 95° C. A control sample was scoured using a solution of Detergyl (2 g/1) and $Na_2CO_3$ (2 g/l) for 1 hour at 95° C. The liquor to fabric ratio was 15:1. The samples were then dyed with Procion Red HE-7B in the manner described in Example 8 and subjected to a single wash and tumble-dry cycle. The following F.I. results were obtained:

| | Woven Fabric | | Knitted Fabric | |
|---|---|---|---|---|
| TAHT g/l | F.I. as dyed | F.I. after W/T | F.I. as dyed | F.I. after W/T |
| — | 2.2 | 3.4 | 3.0 | 3.0 |
| 1 | 1.4 | 2.0 | 1.8 | 2.2 |
| 2 | 1.0 | 1.2 | 1.4 | 1.8 |
| 5 | 1.0 | 1.0 | 0.2 | 0.6 |

It can be seen that fibrillation tendency was significantly reduced even at the lowest concentrations of TAHT.

EXAMPLE 10

Woven solvent-spun cellulose fabric as used in Example 1 was scoured using a solution of TAHT (20 g/l), Detergyl (2 g/l), $Na_2CO_3$ (2 g/l) and $Na_2SO_4$ (25 g/l) at 95° C. for 1 hour. A control sample was scoured in the same way expet that the TAHT was omitted. The fabric samples were then bleached by immersion in a solution of hydrogen peroxide (15 ml of 35% solution per litre), Prestogen PC (1 g/l) (a bleach stabiliser available from BASF AG) (Prestogen is a Trade Mark), Trilon C (0.5 g/l) (Trilon is a Trade Mark of BASF AG) and NaOH (1 g/l) at 50° C., after which the temperature was raised to 85° C. and maintained there for 60 minutes, following which the samples were rinsed. The samples were then dyed with Procion Brown H3R in the manner described in Example 6. The following results were obtained for F.I. after various numbers of wash and tumble-dry cycles:

| | W/T cycles | | | | | |
|---|---|---|---|---|---|---|
| | 0 | 1 | 2 | 3 | 4 | 5 |
| Control | 4.5 | 4.5 | 4.7 | 5.1 | 6.5 | 4.9 |
| Treated | 0.5 | 0.0 | 0.0 | 0.3 | 0.4 | 0.0 |

It can be seen that the reduction in fibrillation tendency obtained by treatment with TAHT was not removed by the bleaching treatment.

EXAMPLE 11

Woven solvent-spun cellulose fabric as used in Example 1 was loaded into a dyeing machine containing a bath which was an aqueous solution at 50° C containing an anionic or nonionic lubricant. The fabric was passed through the bath to wet it and TAHT (4 g/l) was then added to the bath followed by $Na_2CO_3$ (10 g/l) and $Na_2SO_4$ (5 g/l) to give pH 10.5–11.5. The temperature of the bath was raised to 95° C. while the fabric continued to be passed through the bath, and this temperature was maintained for 1 hour. These treatment conditions have been found to give good fixation and resistance to fibrillation. The target fixation level for the TAHT was more than 1%, preferably 1.2–1.5%, by weight on fabric. The fabric was then soaped off and dried to provide a fabric with a low fibrillation tendency.

What is claimed is:

1. A process for the manufacture of solvent-spun cellulose fibre with a reduced tendency to fibrillation which comprises the step of contacting previously dried solvent-spun cellulose fibre with an aqueous solution of a chemical reagent containing three to six functional groups reactive with cellulose, said functional groups being selected from the class consisting of acrylamido groups and acrylic ester groups, wherein the pH of said aqueous solution is in the range from 10 to 13, and wherein said fibre is caused to react with 0.5 to 3 percent by weight of said chemical reagent, based on the weight of said fibre.

2. A process according to claim 1, wherein the chemical reagent contains three to four functional groups reactive with cellulose.

3. A process according to claim 1, wherein said chemical reagent contains at least one ring having attached thereto at least three functional groups reactive with cellulose.

4. A process according to claim 3, wherein said chemical reagent is triacryloylhexahydrotriazine.

5. A process according to claim 1, wherein said fibre is caused to react with 1 to 2 percent by weight of said chemical reagent, based on the weight of said fibre.

6. A process according to claim 1, wherein said fibre is present in a woven fabric.

7. A process according to claim 1, wherein said fibre is present in a knitted fabric.

8. A process according to claim 7, wherein said knitted fabric is in rope form during said step of contacting said knitted fabric with said chemical reagent.

9. A process according to claim 1, wherein said fibre is subsequently dyed.

10. A process according to claim 1, wherein said chemical reagent is substantially colorless.

11. A process according to claim 1, wherein said fibre is of substantially the same color before and after the treatment with said chemical reagent.

12. A process according to claim 1, wherein said fibre has been prepared by extrusion of a solution of cellulose in a tertiary amine N-oxide into an aqueous bath, followed by washing and drying.

13. A process according to claim 1, wherein said functional groups are acrylamido groups.

* * * * *